250-506.1
PTH35 XR 4,116,337 SR

United States Patent [19]

Backus

[11] 4,116,337

[45] Sep. 26, 1978

[54] IMPACT ABSORBING MEANS FOR SHIPPING CASK

[75] Inventor: Harold Adams Backus, Wynnewood, Pa.

[73] Assignee: N L Industries, Inc., New York, N.Y.

[21] Appl. No.: 681,435

[22] Filed: Apr. 29, 1976

[51] Int. Cl.[2] ..... B65D 81/04

[52] U.S. Cl. ..... 206/591; 248/15; 248/354 R

[58] Field of Search ..... 206/521, 591–594; 248/354 R, 15, 20, 22

[56] References Cited

U.S. PATENT DOCUMENTS

| | | | |
|---|---|---|---|
| 1,951,217 | 3/1934 | Slocum | 248/15 |
| 3,130,890 | 4/1964 | McCormack | 206/521 |
| 3,608,495 | 9/1971 | DeMare | 206/521 |
| 3,608,769 | 9/1971 | Gablin | 206/521 |
| 3,847,426 | 11/1974 | McGettigan | 206/521 |

FOREIGN PATENT DOCUMENTS

| | | | |
|---|---|---|---|
| 826,811 | 1/1952 | Fed. Rep. of Germany | 248/354 R |
| 814,886 | 9/1951 | Fed. Rep. of Germany | 248/354 R |

*Primary Examiner*—William Price
*Assistant Examiner*—Douglas B. Farrow
*Attorney, Agent, or Firm*—Gerald K. White

[57] ABSTRACT

Casks for shipping spent radio-active fuel elements are protected against damage by providing impact absorbing means at each end of the cask, the impact absorbing means being designed to absorb end-on and side impact as well as angular impact forces.

9 Claims, 3 Drawing Figures

IMPACT ABSORBING MEANS FOR SHIPPING CASK

BACKGROUND OF INVENTION

Nuclear chain fission reactions and the steady increase in the development and use of nuclear reactors has produced an ever increasing demand for improved means for transporting the irradiated reaction fuel elements, sometimes referred to as spent fuel elements, to processing plants where significant amounts of the original fissionable material are recovered.

It is recognized, however, that the spent fuel elements contain many highly radio-active fission product isotopes; and that considerable heat is developed by the decay of these radio-active materials. Hence, in the interest of public safety, shipping containers or casks used for transporting these highly radio-active materials must meet very stringent safety requirements. These will include radiation shielding to protect the public from gamma and neutron emissions, and the heat generated by the decay of the radio-active isotopes. Moreover, the cask must have sufficient structural strength to withstand rupture in the event of a highway accident, railroad derailment or the like, and be capable of gamma and neutron containment even when subjected to high temperatures as in the case of an accidental fire.

Of singular importance with respect to inadvertent dropping or dislodgment of a shipping cask from a rail-car or truck, such as might occur in the case of a derailment or highway accident, is means for protecting the cask against rupture. Of the few shipping casks presently in use, most of these have no impact absorbing means as such or at most provide some form of resilient means on one or both ends of the cask for absorbing end-on impact.

SUMMARY OF INVENTION

The instant invention relates to new and novel impact absorbing means adapted to be readily attached to and removed from each end of a shipping cask to protect the cask from rupture or deformation if accidentally dropped, the impact absorbing means of this invention being characterized by an extended annulus structure designed to provide protection against end-on, lateral and angular impact forces wherein the kinetic energy of the system upon impact resulting from a 30 foot sidewised drop or a 30 foot end drop is spent in the deformation of the impact absorbing structure — the latter being so designed that at the end of the failure mode no contact will have been made between any portion of the shipping cask and the surface of contact.

Specifically the impact absorbing structure of this invention comprises mounting means in the form of a stainless steel ring adapted to be detachably secured to an end of the shipping cask; and a composite annulus secured to said mounting means perpendicular to the plane thereof such that when the mounting means is secured to an end of the cask its composite annulus is concentric therewith and extends forwardly or rearwardly thereof, as the case may be, in a cantilever type structure. In the embodiment shown herein the composite annulus comprises an annular, aluminum base-member or support for a plurality of rings of balsa wood retained in stacked relationship between overlapping inner and outer aluminum metal bands held together by annular weldments, the rings of balsa wood being separated from each other by floating aluminum rings. Thus in the event of end-on impact, as for example, when the cask is dropped vertically, the force of impact will be totally absorbed in the progressive shearing of the annular weldments attended by telescoping and deformation of the metal bands and the crushing of the successive rings of balsa wood. The force of a side impact will be absorbed in part by a lateral crushing of the balsa wood and metal bands and in part by deformation of the annular, aluminum base member of the composite annulus; while corner impact will be absorbed by deformation of the composite annulus due to a combination of end-on and lateral impact forces.

PREFERRED EMBODIMENT OF INVENTION

Figure 1:
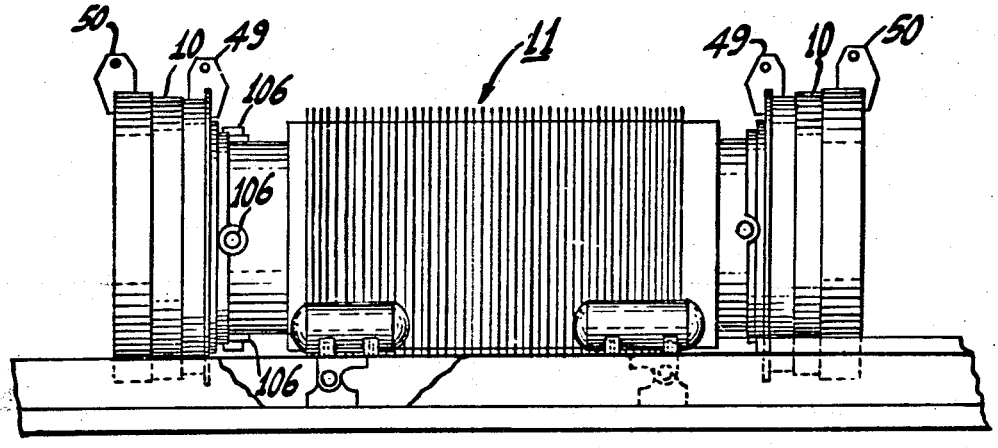
FIG. 1 is a schematic side elevation of a shipping cask having the impact absorbing means of this invention attached at each end thereof.
Figure 2:
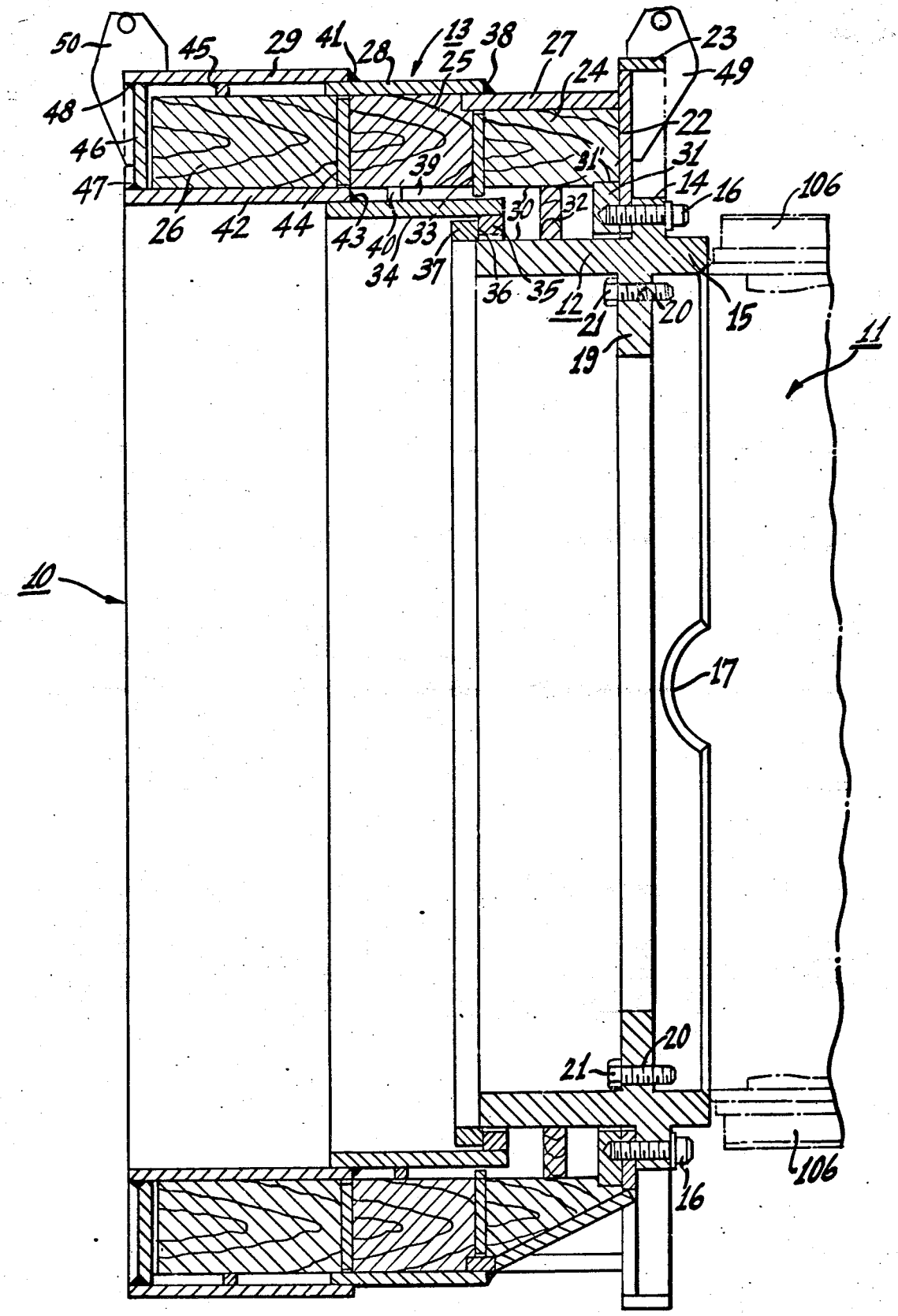
FIG. 2 is an enlarged side elevation, in section, of the impact absorbing means of this invention showing, in phantom, the bottom-end of the shipping cask to which the impact absorbing means is secured.

Referring to FIG. 1, the impact absorbing means of this invention is indicated generally at 10 and is adapted to fit over either end of a shipping cask 11, preferably one impact absorbing unit at each end of the cask, and to be securely bolted thereto, the overall diameter of each unit 10 exceeding that of the shipping cask such that in the event the cask is inadvertently dropped on its side, the force of impact will be wholly absorbed by the impact absorbing structure at each end thereof. As shown especially well in FIG. 2, each impact absorbing means 10 comprises mounting means in the form of a stainless steel ring 12; and a composite annulus, indicated generally at 13, adapted to be bolted to the stainless steel mounting ring 12. To this end the latter is provided with an integral annular flange 14 extending outwardly, radially from its periphery adjacent its rim 15, the annular flange 14 having a plurality of circumferentially spaced bolt holes for accommodating holding bolts 16 for bolting the composite annulus 13 thereto. In the embodiment shown herein, the rim 15 of the stainless steel mounting ring 12 is provided with a semi-circular relief recess 17 to provide clearance for the lifting trunnions 106 of the cask as indicated in FIG. 1.

By way of illustration only, a stainless steel mounting ring designed to be secured over the end of a rail-car cask would have an internal diameter of about 71 inches, an external diameter of about 77¼ inches, a width of about 21 inches and a thickness of about 3 inches. It will be understood, however, that these specific dimensions are not limiting of the invention and may be varied depending on the size and weight of the shipping cask.

Intermediate the rim 15 of the stainless steel mounting ring 12 and its forward end is an integral, concentric, annular mounting flange 19 which extends inwardly radially from the inner surface of the ring and is provided with a plurality of circumferentially spaced bolt holes 20 for accommodating holding bolts 21 by which the mounting ring 12 is bolted securely to the end of the shipping cask 11.

Turning now to the impact absorbing means per se, the latter comprises a composite annulus, indicated generally at 13, adapted to be secured to the peripheral flange 14 of the stainless steel mounting ring 12 in a cantilever construction, that is to say, with only the inner end of the composite annulus supported. To this end, the inner end of the composite annulus 13 comprises a substantially flat, aluminum annular base-member or support 22, the inside diameter of which corresponds substantially to the outside diameter of the steel mounting ring 12, the annular base-member 22 being adapted to be slipped over the latter from its forward end and moved rearwardly thereon so as to bring up against the aforesaid peripheral flange 14 of the steel mounting ring 12 to which the annular base-member 22 is secured by the bolts 16. In this connection, the inner rim of the annular base-member 22 is reinforced by a flat, aluminum ring 31, of substantially rectangular cross-section, welded to the front face of the annular base-member 22 and apertured to receive the holding bolts 16. Welded to the periphery of the base-member 22 substantially at right angles to the plane thereof is an aluminum ring 23 adapted to form, in effect, an annular flange, the annular base-member 22 and its peripheral flange 23 being designed to absorb a major portion of any side impact forces should the shipping cask be accidentally dropped on its side. For illustrative purposes only then, an annular base-member 22, including its peripheral flange 23, if designed for use with a hundred ton rail cask, such as referred to above, will be approximately 1½ inches thick and have an outside diameter of about 108 inches which is sufficiently greater than the overall outside diameter of the cask that, should the latter be dropped on its side, no contact will occur between any portion of the cask and the impact surface.

The other components of the cantilevered composite annulus 13 comprise an assembly of stacked rings of balsa wood, indicated generally at 24, 25 and 26, respectively, encased by exterior aluminum metal bands 27, 28 and 29, respectively, and interior aluminum metal bands 34 and 42, respectively, the balsa wood and bands assembly being secured, as hereinafter described, to the aforesaid annular base-member 22.

In the instant embodiment of the invention and for illustrative purposes only, each of exterior bands 27 and 28 is approximately 14 inches wide, while the outboard band 29 is approximately 20 inches wide, the latter being dimensioned to telescope over the intermediate band 28 and the intermediate band 28 being dimensioned to telescope over the inboard band 27, the overlapping in each instance being about 2 inches. Thus the overall length of the composite annulus, including its base-member 22, is about 48 inches.

Each balsa wood ring is formed as a laminate substantially rectangular in cross-section with the grain of the wood running in the direction of the longitudinal axis of the composite annulus 13. Further, the balsa wood rings are of different dimensions. Thus the inboard balsa ring 24 is smaller than the intermediate and outboard balsa rings 25 and 26, respectively, both as to its diameter and thickness, its outside diameter, in the instant embodiment, being about 99 inches and the inside diameter about 86 inches. The latter is about 11 inches greater than the outer diameter of the aforesaid stainless steel mounting ring 12, such that when the balsa ring 24 is mounted on the annular base-member 22, in the manner shown, an annular clearance space 30 is formed between the periphery of the stainless steel mounting ring 13 and the annular inside surface of the inboard balsa ring 24. The latter seats on the aforesaid aluminum base-member 22 and is held thereon between the annular shoulder 31' of the flat reinforcing ring 31 and the encircling inboard metal band 27 which, in the embodiment shown herein, is about 1½ inches thick and welded at its base to the aforesaid annular aluminum base-member 22, perpendicular to the plane thereof and inwardly of its periphery. A flat balsa wood retaining ring 32 is wedged in the annular clearance space 30 between the inner surface of the inboard balsa wood ring 24 and the peripheral surface of the steel mounting ring 12. The height of the inboard balsa wood ring 24 is about 12 inches.

The intermediate balsa wood ring 25 is superimposed or stacked on the inboard balsa wood ring 24 but separated therefrom by a flat aluminum or aluminum alloy ring 33 slightly wider than the inboard balsa ring 24 and freely supported thereon adjacent the outer end of the inboard metal band 27. The outside diameter of the intermediate balsa ring 25 is about 100½ inches and its inside diameter about 85 inches, its height being about 12 inches. As shown, the width of the flat metal ring 33 is slightly less than the width of the space between the inner annular wall of the metal inboard band 27 and the peripheral surface of the aforesaid inner metal band 34. As shown, the latter is concentric with the intermediate metal band 28, is about one inch thick and welded at its forward end to the aforesaid annular metal band 42. The opposite or inner end of the metal band 34 is adapted to float in the aforesaid annular clearance space 30 and is provided with a stop-ring 35 of substantially rectangular cross-section welded on its inner annular surface opposite the peripheral surface of the mounting ring 12, the stop-ring 35 being adapted normally to engage the underside of annular shoulder 36 of a stainless steel ring 37 welded to the outer rim of the stainless steel mounting ring 12.

The aforesaid intermediate metal band 28 is substantially opposite and concentric with the aforesaid metal band 34 and of substantially the same thickness, the inside diameter of the intermediate metal band 28 corresponding substantially to the outside diameter of the inboard metal band 27 over which the intermediate band 28 is telescoped and to which it is secured by an annular weldment 38. The intermediate balsa wood ring 25 is supported on the aforesaid flat metal ring 33 in the annular space between the intermediate band 28 and the aforesaid metal band 34, the width of the balsa ring 25 being slightly less than the width of the aforesaid spacing so as to provide an annular clearance space 39 in which is wedged a balsa wood retaining ring 40.

The inside diameter of the outboard metal band 29 is substantially equal to the outside diameter of the intermediate band 28 over which the outboard band 29 is telescoped and secured thereto by an annular weldment 41. Further, the outboard metal band 29 is concentric with but spaced from the aforesaid inner aluminum metal band 42 which is of substantially the same thickness as the outboard band 29, the inside diameter of the inner metal band 42 corresponding substantially to the outside diameter of the aforesaid floating metal band 34 over which the inner rim of the inner metal band 42 is telescoped and secured by an annular weldment 43.

The third or outer balsa wood ring 26 is enclosed between the outboard metal band 29 and the inner metal band 42, the balsa wood ring 26 being superimposed on the intermediate balsa wood ring 25 but separated therefrom by a flat freely floating aluminum or aluminum alloy ring 44. Also, the thickness of the outboard balsa ring 26 is substantially equal to the thickness of the intermediate balsa wood ring 25 and is less than the spacing between the outboard metal band 29 and the inner metal band 42 such that an annular clearance space is provided in which is wedged a retaining ring of balsa wood 45. The height of the outboard balsa wood ring 26 is about 18 inches and as shown, the ring is held in place between the spaced concentric metal bands 29 and 42, respectively, by a flat aluminum or aluminum alloy closure ring 46, which is dimensioned to fit between the spaced, concentric rims of the aforesaid annular metal bands 29 and 42 and to be welded thereto by annular weldments as indicated at 47 and 48 respectively.

In the embodiment shown herein, the impact absorbing structure 10 is adapted to be removably bolted to the end of a shipping cask, as indicated generally in FIG. 1, and to facilitate handling the impact absorbing structure, a pair of lifting lugs 49 and 50 are welded to the top-side of the structure and at opposite ends thereof, the one lug 49 being welded to the exposed face of the aforesaid annular flanged base-member 22, and the other lug 50 to the exposed faces of the annular, outboard band 29 and closure ring 46.

The impact absorbing structure of this invention is thus designed and constructed to perform these wholly dissimilar functions under widely different force and deformation requirements. For example, against side impact at any point around the circumference of the cask, each of the impact absorbing structures at opposite ends, respectively, of the cask is capable of absorbing half the total kinetic energy of the cask with only local flattening of the impact absorbing structures to a comparatively shallow depth. With respect to end-on impact, the overlapping arrangement of the aluminum or aluminum alloy bands and the encased rings of balsa wood provide a telescoping action, measured by the shear failure strength of the welds between the successive aluminum bands, this telescoping action allowing the balsa wood rings to be compressed to a high degree while the floating aluminum rings between successive rings of balsa wood assist in controlling compaction of the balsa wood. Thus the impact absorbing structure is capable of absorbing the total kinetic energy of an end-on 30 foot drop, the impact absorbing device being compressed to a relatively small percentage of its original length; while in the case of corner impact the impact absorbing structure is capable of sufficient deformation to absorb the total kinetic energy of the system.

Figure 3:
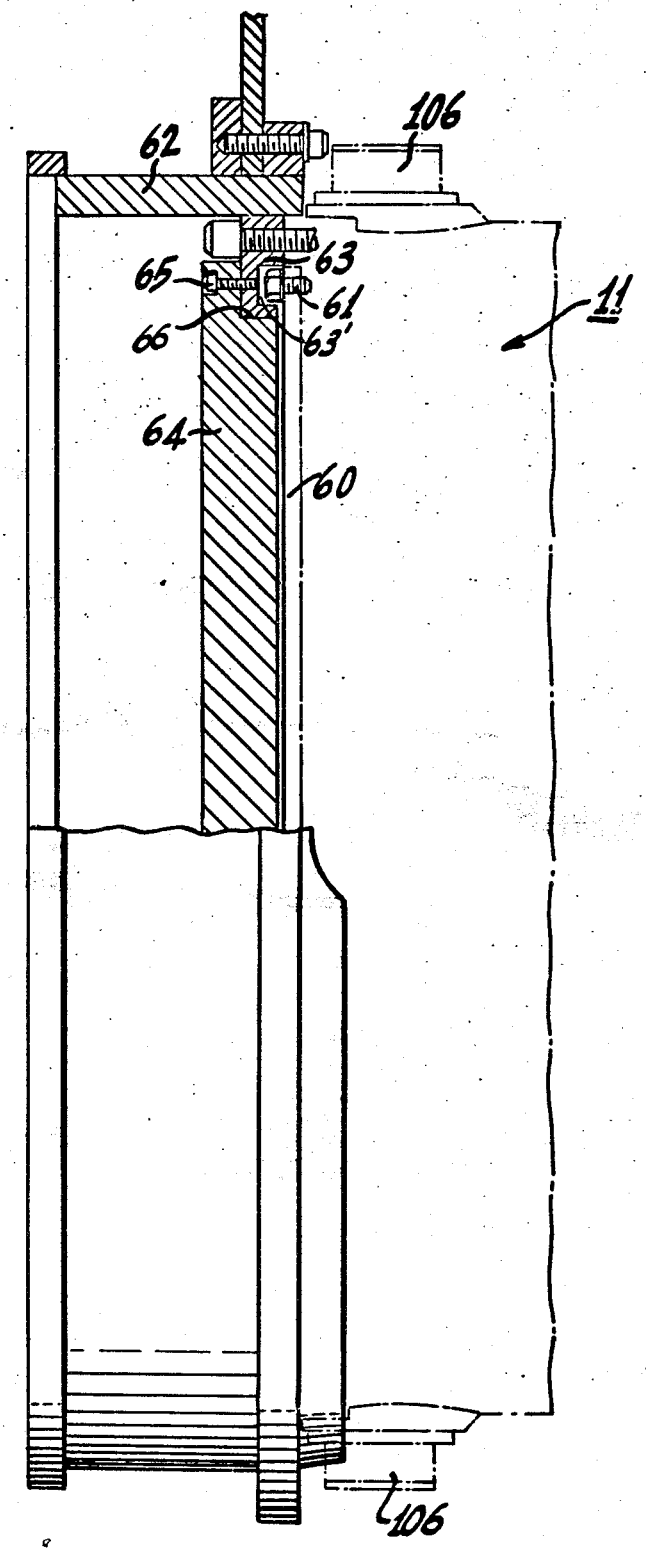
FIG. 3 is a fragmentary enlarged side elevation, in section, of impact absorbing means adapted to be attached to the front end of a shipping cask.

As shown in FIG. 1, the shipping cask is provided at each end with the impact absorbing means of this invention. The foregoing description applies particularly to impact absorbing means adapted to be secured to the bottom or rear-end of the shipping cask. FIG. 3 shows impact absorbing means for attachment to the front end of the cask, the impact absorbing means for the front end of the cask being substantially identical to that shown in FIG. 2 but modified in order to accommodate the dual closure means in the front end of the cask. As shown in phantom, the outer cover 60 of the dual closure means of the cask 11 is secured in place by a plurality of holding bolts 61 spaced circumferentially therearound. Hence, a modified mounting ring 62 is used for supporting the impact absorbing means wherein the inner annular flange 63 of the mounting ring is provided on its inner or rear face with an annular groove 63' substantially rectangular in cross-section and so located as to provide clearance for the heads of the holding bolts 61 when the impact absorbing means is mounted on the front end of the cask. In addition, the annular flange 63 of the modified mounting ring 62 is fortified by a relatively thick aluminum or aluminum alloy plate or disc 64 adapted to be bolted as indicated at 65 to the outer face of the inner annular flange 63 of the modified mounting ring 62, the inner peripheral edge or rim of the plate 64 having an annular notch 66 dimensioned to fit over the inner annular rim of the flange 63. The plate or disc 64 is relatively thick, as for example, about 5 inches thick and thus provides additional strength and rigidity to this end of the cask for resisting puncture and/or deformation on impact. In all other respects, the impact absorbing means for the front end of the cask is identical to that used at the rear or bottom end of the cask.

The foregoing description is specific as to dimensions of the component parts of the impact absorbing means for use with a rail-car shipping cask of 100 tons gross weight, the specific dimensions being determined based on the impact forces developed by a 30 foot drop of the shipping cask either end-on, sideways or at an angle onto an impact surface. It will be understood, however, that other test criteria may be adopted in which case the specific dimensions of the component parts of the impact absorber would be different; and that the specific dimensions shown herein are for illustrative purposes only and are not limiting of the invention.

While this invention has been described and illustrated by the examples shown, it is not intended to be strictly limited thereto, and other variations and modifications may be employed within the scope of the following claims.

I claim:

1. In a shipping cask for radio-active materials the improvement comprising impact absorbing means comprising a composite annulus of balsa wood, being a plurality of axially superimposed balsa wood rings, overlapping metal bands constructed and arranged to encase said balsa wood rings and an annular base-member, annular weldments joining adjacent pairs of said overlapping metal bands, substantially flat metal rings being freely positioned between adjacent balsa wood rings, and mounting means arranged to secure the annular base-member of said composite annulus on an end of said cask.

2. In a shipping cask according to the improvement of claim 1 wherein the grain of said balsa wood rings extends in the direction of the longitudinal axis of said impact absorbing means.

3. In a shipping cask according to the improvement of claim 1 wherein the inner end only of said annulus is constructed and arranged to be attached to said mounting means.

4. In a shipping cask according to the improvement of claim 1 wherein said metal mounting means comprises a steel ring provided with an outwardly extending annular flange, the said annular base-member of said composite annulus being constructed and arranged to be secured to the outwardly extending annular flange of said mounting ring.

5. In a shipping cask according to claim 1 wherein the overlapping metal bands are constructed and arranged to embrace the outer and inner annular surfaces respectively of said balsa wood rings.

6. In a shipping cask according to the improvement of claim 5 wherein the inboard metal band of the overlapping metal bands that embrace the outer annular surfaces of said balsa wood rings is arranged to be fixed to said annular base-member.

7. In a shipping cask according to the improvement of claim 5 wherein the overlapping metal bands that embrace the inner annular surfaces of said balsa wood rings are arranged to be supported integrally from the outer overlapping metal bands of said annulus.

8. In a shipping cask according to the improvement of claim 4 wherein the steel mounting ring is provided with an inwardly extending annular flange, and a disc-shaped metal cover plate is arranged to be removably secured to said inwardly extending annular flange.

9. In a shipping cask according to claim 1 wherein said impact absorbing means is provided with attachments for lifting said impact absorbing means.

* * * * *